US005129523A

United States Patent [19]

Espejo

[11] Patent Number: 5,129,523

[45] Date of Patent: Jul. 14, 1992

[54] FORM HOLDER

[76] Inventor: Eusebio H. Espejo, 1419 Alma St., San Pedro, Calif. 90731

[21] Appl. No.: 708,233

[22] Filed: May 31, 1991

[51] Int. Cl.[5] ..... A47F 7/00

[52] U.S. Cl. ..... 211/51; 211/59.3; 312/71; 312/50

[58] Field of Search ..... 211/51, 59.3, 16; 312/319, 71, 50, 190

[56] References Cited

U.S. PATENT DOCUMENTS

| | | | |
|---|---|---|---|
| 1,415,170 | 5/1922 | Gurney | 211/51 |
| 1,568,515 | 1/1926 | Ligon | 211/51 |
| 2,651,420 | 9/1953 | Wray et al. | 211/51 |
| 2,927,699 | 3/1960 | McGraw | 211/51 |
| 3,764,019 | 10/1973 | Creamer | 211/51 X |

*Primary Examiner*—David M. Purol
*Assistant Examiner*—Sarah A. Lechok
*Attorney, Agent, or Firm*—Irving Keschner

[57] ABSTRACT

A device for holding a stack of forms in a manner such that the first form in the stack is in contact with a first surface of one side of the holding device as each form is removed therefrom. In particular, the device comprises a front portion, side portions, a rear portion, a bottom portion and a top open portion to allow insertion of the forms. The front portion is fixed and is made of transparent material. The stack of forms is positioned in the enclosure between a moveable plate and the front portion of the device, the rear portion extending inwardly from the top toward the bottom portion of the device. After the forms are positioned between the front member and the moveable plate member, force exerting means are positioned between the rear portion of the device and the moveable plate member. Sufficient force is applied to the moveable plate member to maintain the forms in a compact, substantially rigid stack with the first form in the stack being forced into substantially planar contact with the front portion of the device even as the stack is depleted. As the number of forms in the stack decreases, the force exerting means moves downward in the channel area formed between the rear portion of the device and the moveable plate member maintaining substantially constant force on the stack as it is being depleted.

9 Claims, 2 Drawing Sheets

FORM HOLDER

BACKGROUND OF THE INVENTION

1. Field of the Invention

The present invention relates to a holding device, and in particular, a form or document holding device which in a simple and efficient manner enables a stack of forms positioned within the device to be maintained so that each form in the stack can be easily removed while allowing information on the first form in the stack to be easily viewable by an observer.

2. Description of the Prior Art

Receptacle devices for holding or storing various items, such as papers, forms, documents or other similar types of material have been available in the prior art for many years. For example, many of such holding devices have been used, for retail display purposes whereby various documents or forms placed in the holder can be removed and utilized when desired. One of the problems with these prior art devices is that documents or forms which are of an extra long length tend to fold or bend over when placed in a typical holding device, thus creating an unaesthetic appearance and more importantly preventing information printed on the form from being seen by an observer. Even if the forms are smaller sized and do not tend to bend over the front portion of the device, as the stack is being depleted the forms tend to spread apart in the holding device, again making the display aesthetically unappealing and also preventing information on the forms from being seen by an observer.

What is therefore desired is to provide a holding device which is simple and relatively inexpensive, but which allows a stack of forms being held in the device to be maintained under a compressive force such that the forms are prevented from bending over, and more importantly, enables the information on at least one surface of the forms to be viewed as the stack is being depleted.

SUMMARY OF THE INVENTION

The present invention provides an improved form holding device which prevents the forms from bending over when placed in the holding device and also places the stack of forms under a compressive force such that information on one surface of the first form in the stack may be viewable through the front transparent portion of the device.

In particular, the holding device of the present invention comprises an enclosure having front, side, rear and bottom portions, the front surface being made of a transparent material. A moveable plate member is also provided within the enclosure, a stack of forms to be displayed being positioned between the front portion and the moveable plate member. The rear portion of the holding device extends inwardly at an angle from the top towards the bottom portion and forms a channel area between the moveable plate member and itself, the channel width decreasing towards the bottom portion of the holding device. A force exerting member is positioned initially at the widest portion of the channel after a stack of forms is positioned between the front portion of the device and the moveable plate member. The force exerting member assumes an initial position within the channel area which is dependent on the width of the form stack (number of forms) and the characteristics of the force exerting member including its weight and shape. As the form stack is depleted, the force exerting member moves downwardly within the channel area and maintains a compressive force on the remaining forms within the stack. The first form in the stack thus is always forced into substantially planar contact with the inner surface of the front portion of the enclosure.

The force exerting main member can take various forms such as a solid elongated cylindrical member, an elongated shaft having cylindrical portions at each end, and, in the preferred mode, a pair of spherical ball members which are positioned on opposite sides of the channel area.

The present invention thus provides a relatively inexpensive and easily fabricated holder device which overcomes the above noted disadvantages of prior art holder devices.

DESCRIPTION OF THE DRAWING

For a better understanding of the invention as well as other objects and further features thereof, reference is made to the following description which is to be read in conjunction with the accompanying drawing wherein.

DESCRIPTION OF THE INVENTION

Figure 1:
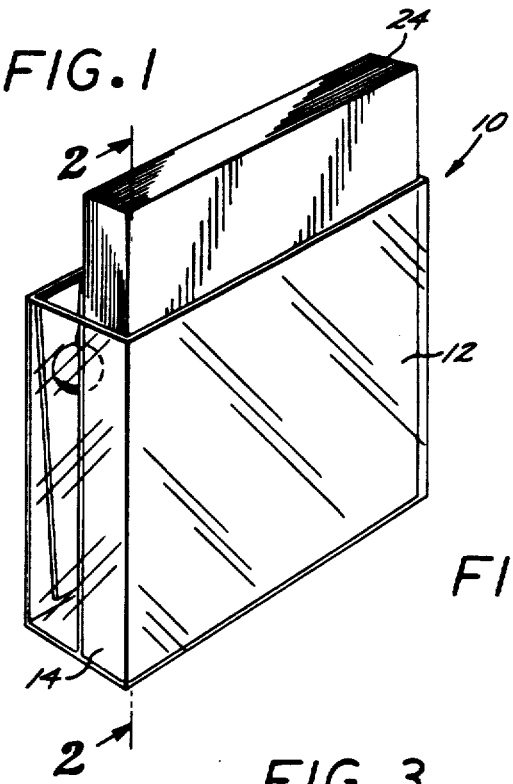
FIG. 1 is a perspective view of the form holding device of the present invention.

Referring now to FIGS. 1-6, a prospective view of the novel form holder device 10 of the present invention is illustrated. It should be noted that the term "form" as utilized herein includes documents, sheets of blank printed paper, etc. Device 10 comprises an enclosure having an open top portion, a front transparent portion 12, side portions 14 and 16, rear portion 18 and bottom portion 19. Rear portion 18 extends from the top edges 21 and 23 of sides 14 and 16, respectively, downwardly at an angle towards bottom portion 12 as illustrated. A moveable plate member 22 is positioned within the device 10 and a stack of forms 24 is positioned between member 22 and front member 12 as illustrated.

In accordance with a further teaching of the present invention, a force exerting member 25 is provided in the channel area formed between members 18 and 22 to apply a force to member 22 such that stack 24 is maintained in a substantially vertical direction and positioned firmly against the rear surface 25 of front member 12. This allows information on the surface of the forms in contact with surface 25 to be seen through the transparent member 12. In the embodiment shown in FIGS. 1-6, the force exerting member comprises a pair of ball members 26 and 28 joined by cords 30 and 32, respectively, connected to overhang member 34 at point 36. The other end of the cords 30 to 32 extend into the ball members 26 (shown in phantom in FIG. 2). Although the ball members can be made of a variety of materials, plastic material is preferably utilized.

Figure 2:
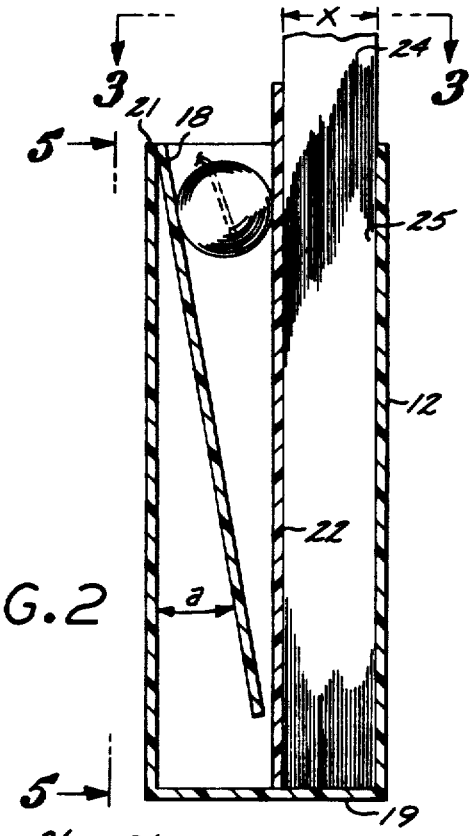
FIG. 2 is side sectional view along line 2—2 of FIG. 1.
Figure 3:
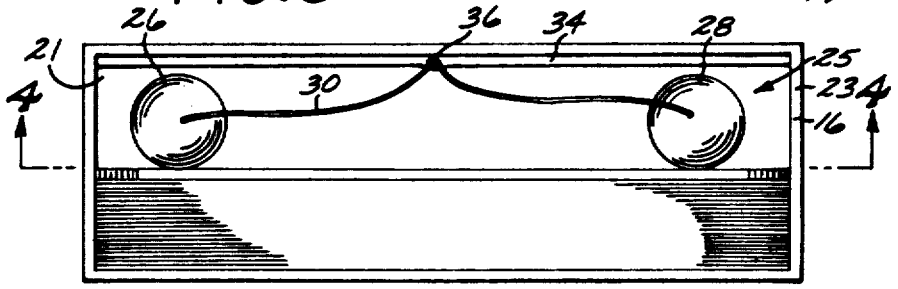
FIG. 3 is a view along line 3—3 of FIG. 2.
Figure 4:
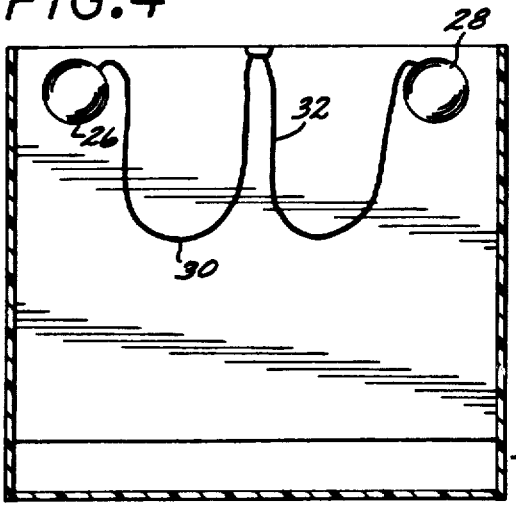
FIG. 4 is a view along line 4—4 of FIG. 3.
Figure 6:
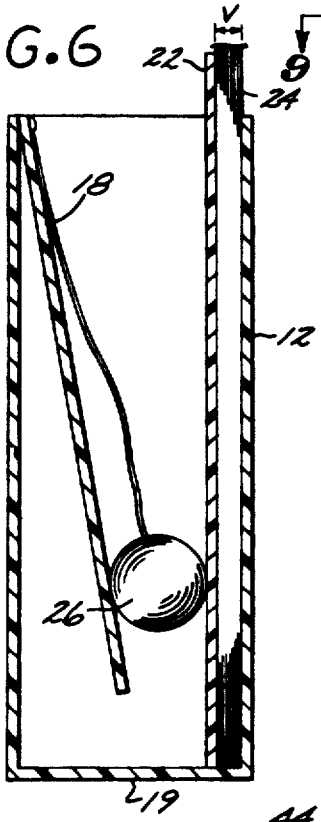
FIG. 6 is a side sectional view showing the ball shaped force exerting members near the bottom of the channel area.

As shown in FIGS. 1 and 2, when a stack of forms 24 with a width X (corresponding to the number of forms making up the stack) is positioned between the moveable plate member 22 and the front member 12, ball members 26 and 28 are inserted in the channel area formed between members 18 and 22. Due to the frictional contact force between the contacting surfaces of members 18 and 22, ball members 26 and 28 initially are at rest at a position near the top of the channel area. It should be noted that although the ball members 26 and 28 are shown joined to a single point 36, each ball member could be joined separately to the overhang 34 at points closer to their respective edges 14 and 16. When the stack is depleted by removing individual forms therein, the thickness of the stack also decreases. As this is happening, the ball members 26 and 28 move downwardly by the force of gravity in the channel area formed between the members 18 and 22. As illustrated in FIG. 6, when the stack thickness is Y, the ball members have fallen to the position shown near bottom portion 19. This occurs in a substantially continuous operation and as the stack is depleted (forms removed) is designed to maintain a constant pressure or force on plate member 22 which in turn forces the stack and, in particular the front sheet of the stack, into intimate contact with rear surface 25 of front portion 12.

Figure 5:
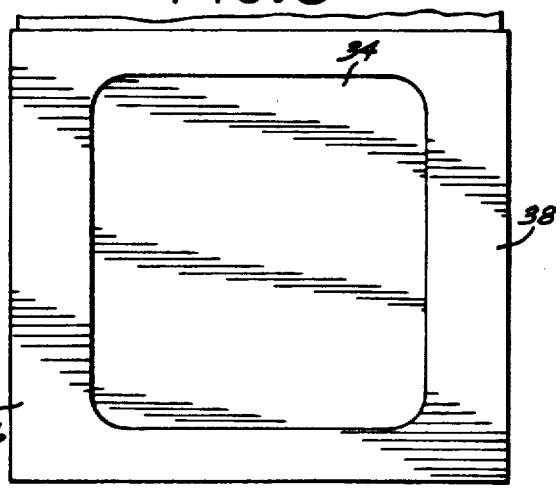
FIG. 5 is a view along line 5—5 of FIG. 2.

FIG. 5 is a rear view of the holder device 10 and illustrates a open space 34 which operates to both to reduce the overall weight (and therefor cost) of the device and also enables a person to grip the device when necessary. In this configuration the ball members are located in a manner such that when they are descending due to the force of gravity they do so along the solid area portions 36 and 38 of rear member 18.

Figure 7:
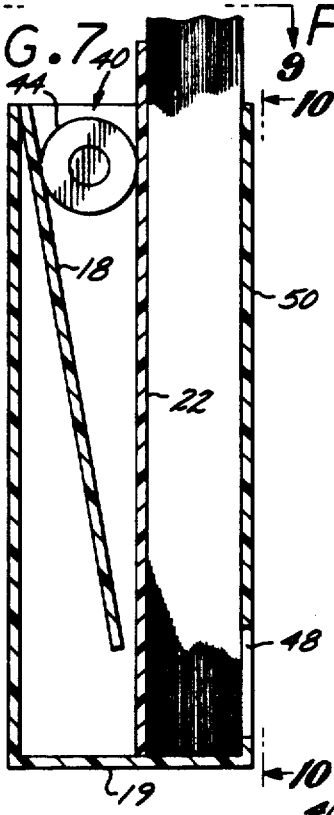
FIG. 7 is a sectional view similar to FIG. 2 showing the use of a different force exerting member.

FIG. 7-10 illustrates another version of the force exerting member which can be utilized in the present invention. It should be noted that identical reference numerals utilized in the figures indicate that the referenced items are identical. The force exerting member 40 shown in FIGS. 7-10 comprises an elongated cylindrical member 42 and cylindrical shaped plastic members 44 and 46. The use of curved contacting surfaces in the force exerting members 23 and 40 enables the members to move smoothly along the contacting surfaces on members 18 and 22. FIG. 7 also illustrates a modification to the holding device enclosure shown in FIGS. 1-6. In particular, an elongated aperture 48 is formed near the bottom of the front portion 50 and allows the force exerting member 40 to be removed from the holder device as it nears bottom portion 19 (i.e., when the stack is depleted).

Figure 8:
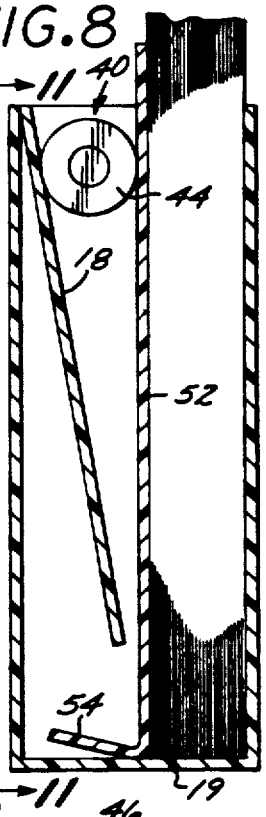
FIG. 8 is a modified version of the embodiment shown in FIG. 7.
Figure 9:
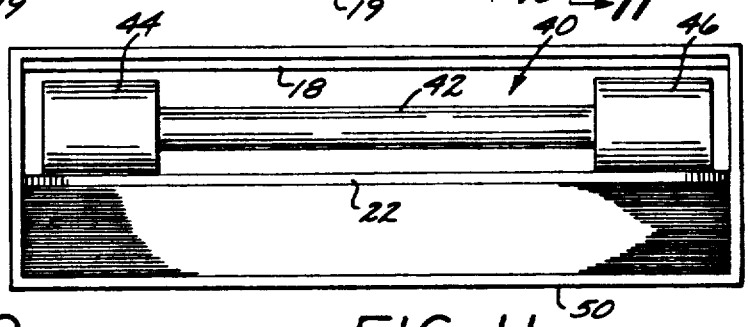
FIG. 9 is a view along line 9—9 of FIG. 7.

FIG. 8 illustrates another modification to the holding devices shown in FIGS. 1-7. In this embodiment, the moveable plate member 52 has an angled portion 54 at the bottom thereof to receive the force exerting member 44 as it reaches the bottom of the holding device 10.

Figure 10:
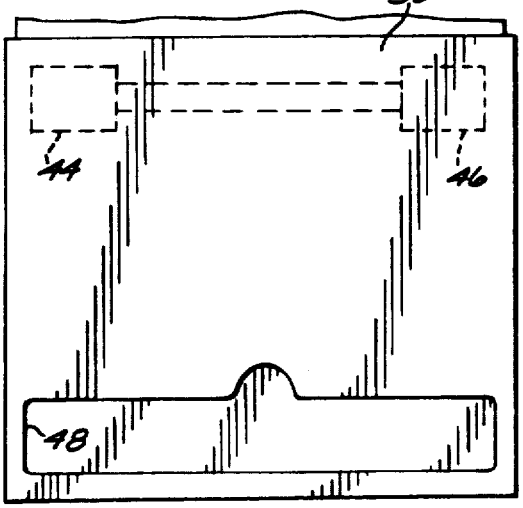
FIG. 10 is a view along line 10—10 of FIG. 7.

FIG. 10 is a front view of the embodiment shown in FIG. 7 and illustrates more clearly the aperture 48. The force exerting member is removed through aperture 48 after plate member 22 is first removed from the enclosure.

Figure 11:
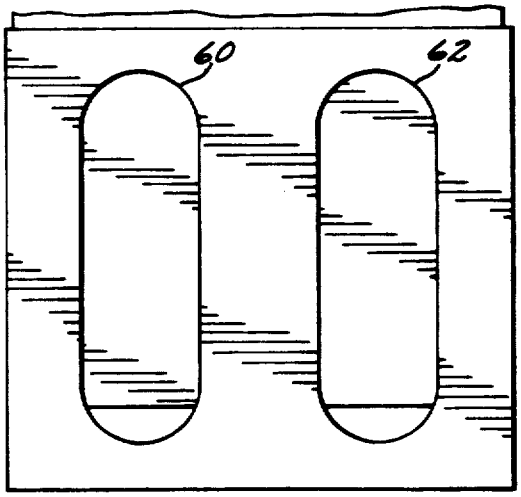
FIG. 11 is a view along line 11—11 of FIG. 8.

FIG. 11 is a rear view of the FIG. 8 embodiment and shows open portions 60 and 62 which function both to reduce the weight of the holding device (and thus reduce cost) and also enables the holder to be grasped by a user if required.

It should be noted that the force exerting members, moveable plate members, the cutout design in the rear members of the enclosures, etc. can be used interchangeably and still fall within the scope of the present invention. For example, force exerting member 44 can be used in the embodiment shown in FIGS. 1-6, plate member 52 can be utilized in lieu of plate member 22, etc.

The present invention thus provides a relatively inexpensive and simple manner of providing a form holder which enables a stack of forms to be held securely against a front transparent member thus serving both to prevent the forms from bending over the front member and also allowing information on the first form in the stack to be viewed by an observer through the transparent front member as the stack is depleted.

While the invention has been described with reference to its preferred embodiments, it will be understood by those skilled in the art that various changes may be made and equivalents made be substituted for elements thereof without departure from the true spirit and scope of the invention. In addition, many modifications may be made to adapt a particular situation or material to the teaching of the invention without departing from its essential teachings.

What is claimed is:

1. A device for holding a stack of forms comprising an enclosure having front, side, bottom and rear portions;

A moveable plate member positioned within said enclosure, the stack of forms being positioned between said moveable plate member and a first surface of the front portion of said enclosure; and force exerting means positioned within said enclosure and in contact with one surface of said rear portion of said enclosure and a first surface of said moveable plate member whereby force is applied to said stack of forms in a manner whereby the first form in said stack is maintained in substantial planar contact with the first surface of said enclosure front portion, said rear portion of said enclosure extending inwardly from the top towards the bottom portion of said enclosure forming a channel area having a width which decreases towards said bottom portion.

2. The device of claim 1 wherein said force exerting member moves downwardly within the channel area as the number of forms in the stack is depleted.

3. The device of claim 2 wherein said force exerting member remains in contact with said first surface of said rear portion and said first surface of said moveable plate member as it moves downwardly within said channel area.

4. The device of claim 3 wherein said force exerting means comprises an elongated rod member of a first diameter having cylindrical members of a second diameter at each end.

5. The device of claim 4 wherein said second diameter is greater than said first diameter.

6. The device of claim 3 wherein said force exerting member comprises a cylindrically shaped rod member.

7. The device of claim 3 wherein said force exerting member means comprises first and second spherically shaped members attached to said enclosure adjacent to the top portion thereof.

8. The device of claim 7 wherein each of said spherically shaped members are attached to the same point on said enclosure by elongated members.

9. The device of claim 1 wherein said rear portion has at least one opening formed therein.

* * * * *